US007560603B2

(12) United States Patent
Connor

(10) Patent No.: US 7,560,603 B2
(45) Date of Patent: Jul. 14, 2009

(54) FUEL FOR JET, GAS TURBINE, ROCKET AND DIESEL ENGINES

(75) Inventor: Daniel Stedman Connor, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 657 days.

(21) Appl. No.: 10/902,715

(22) Filed: Jul. 29, 2004

(65) Prior Publication Data

US 2005/0023188 A1 Feb. 3, 2005

Related U.S. Application Data

(60) Provisional application No. 60/491,750, filed on Aug. 1, 2003.

(51) Int. Cl.
*C07C 9/00* (2006.01)
*C07C 7/20* (2006.01)
*C10L 1/04* (2006.01)

(52) U.S. Cl. ..... 585/14; 585/1; 208/15; 44/265; 44/281

(58) Field of Classification Search ..... 585/1, 585/14; 208/15; 44/265, 281
See application file for complete search history.

(56) References Cited

U.S. PATENT DOCUMENTS 3,272,879 A * 9/1966 Stahly ..... 585/25
3,773,652 A * 11/1973 Dille et al. ..... 585/265
4,251,346 A 2/1981 Dry et al.
4,318,797 A 3/1982 Jager et al.
4,744,801 A * 5/1988 Taylor et al. ..... 44/304
4,871,444 A 10/1989 Chen et al.
5,171,916 A 12/1992 Le et al.
6,274,029 B1 8/2001 Wittenbrink et al.
6,296,757 B1 10/2001 Wittenbrink et al.
6,309,432 B1 10/2001 Wittenbrink et al.
6,392,109 B1 5/2002 O'Rear et al.
2002/0103096 A1 * 8/2002 Kott et al. ..... 510/357
2003/0085153 A1 * 5/2003 O'Rear ..... 208/63

FOREIGN PATENT DOCUMENTS

WO WO 02/22766 A 3/2002

OTHER PUBLICATIONS

G.C. Feighner, The Manufacture of Detergent Alkylate, Journal American Oil Chemists Society, 1958, pp. 520-524, 35.
Kirk-Othmer, Encyclopedia of Chemical Technology, 3rd Edition, vol. 2, 1978, pp. 59-61.
Kirk-Othmer, Encyclopedia of Chemical Technology, 2nd completely revised edition, vol. 16, 1968, pp. 581-582.
J. Cummins, M. Yoneyama, Nonene (Propylene Trimer) and Tetramer, SRI International, Chemical Economics Handbook, Aug. 2001 pp. 678.5000A-P.
New solid-bed alkylation technology for LAB, World Surfactants Congress, 4th, Barcelona, Jun. 3-7, 1996, pp. 177-189.
Ullmann's Encyclopedia of Industrial Chemistry, 6th Completely Revised Edition, 2003, vol. 35, pp. 293-368.
Kirk-Othmer, Encyclopedia of Chemical Technology, 4th Edition, 1992, vol. 3, pp. 788-812.
Kirk-Othmer, Encyclopedia of Chemical Technology, 4th Edition, 1994, vol. 12, pp. 341-342; 373-388.
Gerhartz, W.; Yamamoto, Y.S., Ullmann's Encyclopedia of Industrial Chemistry, vol. A1, 1985, Weinheim, VCH Verlag., DE, XP002331665, p. 190, col. 1, paragraph 2.1.

* cited by examiner

*Primary Examiner*—Walter D Griffin
*Assistant Examiner*—Lessanework Seifu
(74) *Attorney, Agent, or Firm*—Laura R. Grunzinger

(57) ABSTRACT

A fuel or fuel blendstocks for jet, gas turbine, rocket, and diesel engines, particularly jet and rocket engines utilizing components of conventional petroleum not currently utilized for jet, gas turbine, rocket, and diesel fuels, such as benzene, butanes, butanes, and methyl tert butyl ether (MTBE) alkylated with aromatic moieties to make monoaromatics used in jet and diesel fuels. Additionally, a fuel having such monoaromatics has multiple desired properties such as higher flash point, low pour point, increased density, better lubricity, aerobic degradability, reduction in toxicity, and additionally can deliver benefits in blendstocks.

13 Claims, No Drawings

FUEL FOR JET, GAS TURBINE, ROCKET AND DIESEL ENGINES

FIELD OF THE INVENTION

The present invention relates to a fuel or fuel blendstocks for jet, gas turbine, rocket, and diesel engines, particularly jet fuel for gas turbines and rocket engines.

BACKGROUND OF THE INVENTION

The availability and quality of natural resources for jet, gas turbine, rocket, and diesel fuels presents unique and difficult technical challenges. An identified problem is the increasing demand for jet and diesel fuels for aircraft and for motor vehicles. As quality requirements for fuels are increasing, the ability to produce acceptable fuels from a conventional petroleum barrel of crude is decreasing. Due to the fact that conventional barrels of crude are becoming, on the average, heavier (e.g., more polycyclic) and containing more sulfur, the need for acceptable fuels is an unmet need. At the same time, the drive for cleaner fuels results in highly hydrogenated, less dense fuels that result from processing to remove sulfur and polycyclics such as naphthalenes. It is believed that highly purified conventional fuels and highly paraffinic Fischer-Tropsch fuels are of lower densities, lack seal swelling abilities, and lubricity. Restrictions on gasoline content make available carbon containing components not having any immediate uses, such as benzene, butanes, butanes, and methyl tert butyl ether (MTBE).

Circulating fuel in and around an aircraft commonly provides the sole means of cooling engines, lubes, electronics, wings, etc. of an aircraft. Significantly increased heat loads are an identified problem as fuel economy/performance considerations raise engine temperatures. More flights are using polar routes and therefore fuels must now withstand broader temperature ranges from extreme cold to hot temperatures. The ability to raise fuel flash point to 60° C. or more while maintaining pour points below −60° C. remains an unmet need. Another desired result of raising flash points above present specifications is desirable to increase chances of surviving crashes or fires when fueling and flying aircraft.

It is also desired to have a flexible and diversified fuel source so that not only are materials for fuels derived from petroleum based components, but may be derived from natural gas, coal, petroleum reside, biomass, and waste feedstocks via syngas. However, such flexibility and diversification is currently not widely available. Therefore, there exists a need to address the issues discussed hereinabove.

SUMMARY OF THE INVENTION

The present invention relates to a fuel composition for use in jets, gas turbines, rockets, or diesel engines comprising:

(a) from about 5% to about 99% by weight of the fuel composition of a highly branched alkylaromatic or alkylcyclohexane compound comprising an alkyl moiety having from 5 to 25 carbon atoms and an average of more than 1.0 branches per moiety, and an aromatic moiety selected from the group comprising benzene, toluene, xylene, a cyclohexane derived from an aromatic moiety, and mixtures thereof; wherein said alkylaromatic or alkylcyclohexane comprises in the alkyl moiety a ratio of nonquaternary carbons to quaternary carbons from about 10:1 to 3:1;

(b) at least about 0.01% of fuel additives; and (c) about 0% to about 90% of conventional jet, gas turbine, rocket or diesel blendstocks, preferably low sulfur refined petroleum blendstocks or paraffinic Fischer Tropsch blendstocks, isoparaffinic Fischer Tropsch blendstocks, and mixtures thereof.

DETAILED DESCRIPTION OF THE INVENTION

Restrictions on gasoline content, such as benzene, butanes, and methyl tert butyl ether (MTBE) have made or will make available components which can be used to alkylate aromatics to make monoaromatics used in jet and diesel fuels. The use of monoaromatics as fuels, specifically alkylbenzenes made from benzene and surplus conventional petroleum or Fischer-Tropsch derived propylene and/or butene oligomers (Polygas), may be beneficial in multiple ways. Use of such benzenes and propylene and/or butene oligomers would add to the volume of jet fuel, which is an identified need, while removing undesired materials from gasoline for use in motor vehicles. Additionally the fuel of the present invention has multiple desired properties such as higher flash point, lower pour point, high temperature stability, oxidative stability, increased density, better lubricity, resistance to microbial growth, reduction in toxicity in its own right, and can deliver benefits in blendstocks. These identified properties provide improved fuels especially for higher performance aircraft featuring conventional jet, ramjet, scramjer, rocket, or pulse detonation engines and the like.

The fuel of the present invention utilizes components of a petroleum barrel not currently utilized for jet, gas turbine, rocket, and diesel fuels. Oligomerization of $C_3/C_4$ olefins normally removed from gasoline to make $C_5$ to $C_{18}$ highly branched olefins that are used for alkylation of aromatics such as benzene, or optionally aromatics hydrogenated to cyclohexanes, to form a fuel having several desirable attributes for jet, gas turbine, rocket, fuel and blendstocks for diesel fuel. The fuels of the present invention may be produced from natural gas, coal, petroleum, resides, oil shale, biomass, or waste feedstocks via syngas using Fischer-Tropsch and subsequent processing. The diversified production sources listed provide highly desirable fuel source flexibility.

An identified problem in the jet and diesel fuel area is the ability of a fuel to deliver multiple properties such as lower pour point, high temperature stability, increased lubricity, increased flash point, seal swelling ability, reduction in toxicity, among other desired properties for fuels. Another desired trait of jet and diesel fuels is the ability to be compatible in blendstocks with conventional or ultra low sulfur jet, gas turbine, rocket and/or diesel fuels. The fuel of the present invention comprises alkylaromatics that provide multiple benefits and can be compatible in fuel blendstocks with conventional or ultra low sulfur jet, gas turbine, rocket, and/or diesel fuels. Additionally, the alkylaromatics may be hydrogenated to alkylcyclohexane to make fuels capable of providing endothermic cooling in special high performance aircraft engines/airframes of the future.

The fuel of the present invention may also be preferably used as part of a blendstock for use in hydrocarbon fuel-powered equipment, nonlimiting examples such as camp stoves, chainsaw, generators, and the like. As used herein "hydrocarbon fuel" means gasoline, kerosene, fuel oil, and diesel. Fuels, herein after referred to as "universal battlefield fuel", such as the fuel of the present invention may be used in various hydrocarbon fuel-powered machines. Furthermore, higher flash point, increased density, better lubricity of the fuel of the present invention's alkylaromatics or blends of alkylaromatics with conventional fuels such as highly processed jet fuels or Fischer-Tropsch jet fuels may render the fuel of the present invention more suitable for use in military diesel engines as well, thus improving applicability of universal battlefield fuels. These benefits could also be useful in common vehicle and off-road diesel fuels generally when blended with highly processed convention or Fischer-Tropsch diesel stocks.

The fuel of the present invention comprises from about 5% to about 99% by weight of the fuel composition comprising at least one highly branched alkylaromatic or highly branched alkylcyclohexane, formed by a Friedel-Crafts alkylation of an aromatic moiety with an alkyl moiety, both discussed below. The aromatic moiety and the alkyl moiety may be obtained from petroleum or non-petroleum feedstocks. For example, coal oil is over 50% by weight benzene.

The highly branched alkylaromatic and/or alkylcyclohexane comprises an alkyl moiety having from 5 to 25 carbon atoms, preferably 5 to 18 carbon atoms, most preferably about 6 to about 12 carbon atoms.

As used herein "highly branched" refers to the average number of branches of the alkyl moiety of the alkylaromatic and/or alkylcyclohexane. The fuel of the present invention preferably comprises between about 20 wt % to about 100 wt % of the alkylaromatic and/or alkylcyclohexane having an alkyl moiety being highly branched. The alkyl moiety comprises an average of about 1.0 to about 5.0 branches per moiety, preferably about 1.5 to about 4.0 branches per moiety. Preferred feedstocks for the alkyl moiety is selected from the group comprising branched olefins, branched alkyl halides, or branched alcohols having from 5 to 25 carbons, preferably 5 to 18 carbons, most preferably a mixture of dimers, trimers, and tetramers of propylene and/or dimers of butylenes, or mixed propylene/butylene oligomers. The olefins may be derived from several well known processes in oil refining, gas processing or from Fischer Tropsch processes. See Kirk-Othmer, 3$^{rd}$ Edition (1978), Vol. 2, pages 59-61, and references contained therein. A preferred embodiment is the oligomers of propylene.

A preferred method of producing propylene tetramer includes heating the olefin feedstocks and injecting the feedstock into a catalyst chamber. Preferred catalysts include kieselguhr, or other suitable silicate, with phosphoric acid, quartz chips coated with phosphoric acid, or a mixture thereof. The catalyst chamber preferably is kept at approximately 6.94 MPa (1000 psig) and 200° C. The effluent from the catalyst chamber is fractionated to recover any unreacted olefin feedstock, and desired faction is used directly for the alkylation step. See G. C. Feighner, J. Am. Oil Chem. Soc. 35, 520-524 (1958); Kirk-Othmer, 2$^{nd}$ Edition (1968), Vol. 16, pages 581-582 and 593-594. The desired fraction, preferably containing oligomers of propylene, are then used to alkylate the aromatic moiety of the fuel of the present invention, preferably the aromatic moiety is benzene.

The highly branched alkylaromatic and/or alkylcyclohexane further comprise an aromatic moiety selected from the group comprising benzene, toluene, xylene, a cyclohexane derived from an aromatic moiety, and mixtures thereof, preferably benzene and cyclohexane. The aromatic moiety, such as benzene, or cyclohexane derived from the aromatic moiety such as benzene, may be derived from petroleum or coal oil.

Furthermore, the alkyl moiety of the alkylaromatic and/or alkylcyclohexane has a ratio of nonquaternary carbons to quaternary carbons from about 10:1 to about 3:1, preferably at least 1 quaternary carbon per molecule, more preferably an average of at least 1.5 quaternary carbons per molecule. In one preferred embodiment of the fuel of the present invention from about 70 wt % to about 100 wt %, preferably from about 80 wt % to about 100 wt % of the alkylaromatic and/or alkylcyclohexane have a quaternary carbon having the alkyl moiey, the aromatic moiety or a cyclohexane derived from the aromatic moiety, and a branch moiety selected from a $C_1$ to $C_4$ alkyl and mixtures thereof.

Any of the alkylaromatics, preferably alkylbenzene, may be partially or completely converted to the corresponding alkylcyclohexanes should lower aromaticity or no aromaticity be required of a specific fuel. Such an embodiment is not preferred due to cost consideration for conventional jet, gas turbine, rocket, and/or diesel fuel composition applications. However, conversion to alkylcyclohexanes may be useful in special aircraft or rocket fuel applications where extra cost is warranted, for example when endothermic cooling properties are desired. The conversion from an alkylaromatic, such as alkylbenzene, to an alkylcyclohexane, may be accomplished by the step of hydrogenating the alkyl aromatic, preferably alkylbenzene, to an alkylcyclohexane.

The alkylaromatics and/or alkylcyclohexanes of the fuel of the present invention may be formed via a Friedel-Crafts alkylation of the alkyl moiety described above with the aromatic moiety; preferably the aromatic moiety is benzene. Catalysts used for the alkylation step are suitable Friedel-Crafts catalysts, preferably hydrogen fluoride and aluminum chloride. Large excess, from about 5 to about 10 moles per mole of alkyl moiety, of the aromatic moiety, preferably benzene, is mixed with the alkyl moiety and the Friedel-Crafts catalyst. The alkylation may be from room temperature (25° C.) to about 50° C. The reaction may be run continuously or batchwise. See G. C. Feighner, J. Am. Oil Chem. Soc. 35, 520-524 (1958). The resulting alkylaromatics may be separated from the catalyst and fractionated to remove impurities.

The fuel of the present invention may deliver one of the properties discussed below; however, it is preferred that multiple benefits are delivered by the fuel of the present invention.

Fuel Density—The fuel of the present invention has a density of at least about 0.700 g/mL, preferably about 0.700 g/mL to about 0.900 g/mL, more preferably from about 0.750 to about 0.860 g/mL. The fuel density may be measured by ASTM D 1298 (API Gravity) or ASTM D 4052 (Digital Density Meter). Fuel density usually is used to predict energy content of a jet fuel composition. Less dense jet fuels generally have a higher gravimetric energy content (energy per unit weight of fuel), and more dense jet fuels have a higher volumetric energy content (energy per unit volume of fuel). A more dense fuel with a high volumetric energy content is generally preferred.

Fuel economy of jet or diesel fuel is related to the heating value or energy content of the fuel. Heating value per liter or gallon is directly proportional to density when other fuel properties are unchanged. Relative density (RD), also called specific gravity, or API gravity (ASTM D 287), more conventional reporting methods for density, may easily be determined by one skilled in the art from the fuel density ranges given for the fuel of the present invention.

The aromatic content of the fuel of the present invention may be measured by ASTM D 1319 for jet and diesel fuels. Aromaticity for diesel fuels may be measured by ASTM D 5186. It is preferred that the fuel of the present invention is essentially free of polycyclic, particularly polycyclic aromatic substitutents, including naphthalenes, alkylnaphthalene, and tetralins, and is essentially free of unreacted benzene (free benzene), toluene, and xylene. As used herein "essentially free" refers to having less than 10 ppm present in the fuel of the present invention.

Freeze Point—The freeze point of fuels can be over a wide range of temperatures. Wax crystals are the first indications that a fuel is freezing. After wax crystals are formed, the fuel becomes a slush of fuel and crystals, and then forms a solid mass. Freeze point, as used herein, refers to the temperature at which the last wax crystal melts, when warming a fuel that has previously been cooled until wax crystals form. Jet fuels generally are discussed in terms of freeze point. Freeze point measurement for jet fuels has several standard test methods, including ASTM D 2386 (Referee Method), ASTM D 4305 (Filter Flow), ASTM D 5901 (Automated Optical Method), and ASTM D 5972 (Automatic Phase Transition Method). Jet fuels require pumpability to move from the jet fuel tank to the jet engine. The pumpability of the jet fuel should be more than 4° C. below the freeze point of the jet fuel. Diesel fuels are generally discussed in terms of pour point or cloud point. Cloud point is measured by ASTM D 2500 and Pour Point is measured by ASTM D 97. The pour point of the fuel of the present invention is at least about −40° C., preferably from about −40° C. to about −80° C., preferably from about −47° C. to about −80° C. for use in jets, gas turbines, and rockets. The pour point of the fuel of the present invention is at least about −20° C., preferably from about −20° C. to about −35° C. for use in diesel engines. The pour point of the fuel of the present invention make it highly desirable for low temperature operability due to good low temperature viscosities. Low Temperature Operability may be measured by IP 309 (CFPP) or ASTM D 4539 (FTFT). Without being limited by theory, it is believed that the low pour point of the fuel of the present invention, despite the molecular weight of the fuel of the present invention, also translates into acceptable flash point, discussed below.

Flash Point—The fuel of the present invention has a flash point from about 30° C. to about 145° C., preferably from about 60° C. to about 110° C. for jet fuels. Flash point for jet fuel may be measured by ASTM D56 (Tag Closed Tester or Referee Method) or ASTM D 3828 (Small Scale Closed Tester). Flash point for diesel fuel may be measured by ASTM D 93 (Pensky-Marten Closed Cup Tester). A raised flash point will be especially useful for hot fueling of fuel tanks. As used herein "hot fuel" means refilling the fuel tank of a machine such as an aircraft or motorized vehicle that is running or still hot from being run. Higher flash points of the fuels of the present invention may also allow for reduction in fueling time critical in military and jumbo civilian aircraft. Another desired result of raising flash points above present specifications is desirable to increase safety, reduce the danger of fuel tank explosions, and increasing chances of surviving crashes or fires when fueling and flying aircraft.

Anti-growth—The fuel of the present invention may provide benefits for inhibiting biological growth. The long term storage of fuels for jet, rocket, and gas turbine poses problems of having biological growth. This benefit may also be useful in maintenance and cleaning of aircraft fueling systems where biological growth may also exist.

Thermal Stability—The fuel of the present invention may demonstrate improved thermal stability, which is especially important to jet and rocket fuels, as these fuels are used to cool engines and other parts of the jet and rocket. Without stability at higher temperatures, gum and particulate formation increases causing damage to engines. Standardized testing includes Jet Fuel Thermal Oxidation Tester (JFTOT) (ASTM D3241). The fuel of the present inventions should meet or exceed conventional fuel thermal stability standards. Thermal stability may be measured in the presence of oxygen (oxidative stability) or the absence of oxygen. It is also desired that the fuel of the present invention has acceptable oxidative stability. Without being bound by theory, it is believed that alkylaromatics having the aromatic moiety attached to a quaternary carbon provides improved oxidative stability.

Lubricity—Lubricity of jet, gas turbine, rocket, and diesel fuel is impacted by the aromatic content as well as the oxygen, nitrogen, and sulfur containing compound content. As regulations seek to decrease oxygen, nitrogen, and sulfur containing compound contents, lubricity of the fuel is decreased. The fuel of the present invention preferably demonstrates self-lubing properties alone (e.g. in a neat form) or in a blendstock. Lubricity for jet fuel is measured by ASTM D 5001 (BOCLE Test). ASTM D 975 measures hydrodynamic lubrication in diesel fuels. Lubricity may also indicate that seal swelling is provided in acceptable ranges. Seal swelling is affected by the presence and absence of aromatic moieties in fuels such as the fuel of the present invention.

Particulate Reduction/Luminosity Reduction—Particulates are formed by incomplete combustion of fuels. These particulates are harmful to the jet and diesel engines mechanically, and can form the smoke emitted from engines. Polycyclics are the major cause of smoke and soot produced by fuels; however, the fuel of the present invention is essentially free of polycyclic aromatics and therefore minimizes the formation of harmful particulates. The fuel of the present invention, when in the form of a jet fuel, has a minimum smoke point of at least 20 mm. Smoke Point is measured by ASTM D 1322. With jet fuels these particulates can become incandescent under the high temperature and pressure conditions of engines. This too can lead to cracks and premature engine failures. The fuel of the present invention or blendstocks of the fuel of the present invention with paraffinic and/or ultra low sulfur kerosene can achieve a minimum smoke point of at least 20 mm.

Other fuel properties may be required by known fuel specifications that have not been discussed above. Properties such as antistatic, corrosion resistance, oxidative stability, and thermal stability in the absence of oxygen, may also be delivered by the fuel of the present invention. The fuel of the present invention may also have less inherent toxicity compared to conventional fuels.

Fuel Additives

The fuel of the present invention may optionally comprises at least about 0.1%, preferably from about 0.1 wt % to about 5% by weight of the fuel composition of a fuel additive.

Jet fuel additives such as antioxidants, metal deactivators, electrical conductivity or static dissipaters, corrosion inhibitors, lubricity improvers, fuel system icing inhibitors, biocides, thermal stability additives, soot/particulate reduction agents, and any combination thereof may be added to the fuels of the present invention. A discussion of these additives may be found in Kirk Othmer Encyclopedia of Chemical Technology, Fourth Edition, Volume 3, pages 788-812, entitled "Aviation and Other Gas Turbine Fuels", specifically, page 795, Table 5.

Diesel Fuel Additives may include cetane index improvers such as 2-ethylhexyl nitrate (EHN), injector cleaning additives, lubricity additives such as fatty acids and esters, smoke suppressants such as organometallic compounds, fuel handling additives such as antifoam additives (i.e., organosilicone compounds), de-icing additives (i.e., low molecular eight alcohols or glycols), low temperature operability additives, drag reducing additives (i.e., high molecular weight polymers) antioxidants (i.e., phenylenediamine), stabilizers, metal deactivators (i.e., chelants), dispersants, biocides, demulsifier, corrosion inhibitors and any combinations thereof may be added to the fuels of the present invention. A discussion of diesel fuel additives may be found in Kirk Othmer Encyclopedia of Chemical Technology, Fourth Edition, Volume 12, pages 341-388, entitled "Gasoline and other Motor Fuels", specifically pages 379-81.

Conventional Jet or Diesel Blendstocks

The fuel of the present invention may optionally comprise conventional jet or diesel blendstocks. Preferably, these blendstocks are ultra low sulfur blendstocks or Fischer Tropsch blendstocks. As used herein "conventional" refers to jet or diesel fuels commercially available or known in the art. Universal battlefield fuel is a preferable blendstocks of the fuel of the present invention.

The fuel of the present invention comprises no greater than 95 wt %, preferably from about 0 wt % to 90 wt %, preferably from 0 wt % to 80 wt %, preferably from 0 wt % to about 50 wt % by weight of the fuel composition of conventional jet or diesel fuels.

Methods of Use

The present invention further comprises a method of powering a diesel engine through the burning of a fuel comprising the steps of compressing air in the diesel engine, injecting the fuel of the present invention, igniting the air and fuel to form a burning mixture.

The present invention further comprises a method of powering a jet or gas turbine engine through the burning of a fuel comprising the steps of drawing air from the front of the jet engine or gas turbine into the jet engine or gas turbine, mixing the air with the fuel of claim 1, igniting the air and fuel mixture to form a burning mixture, and ejecting the burning mixture out of the back of the jet engine or gas turbine.

The present invention further comprises a method of powering a rocket through the burning of a fuel comprising the steps of mixing the fuel of claim 1 with an oxidant such as oxygen or nitrous oxide, igniting the oxygen or nitrous oxide and fuel to form a burning mixture, and ejecting the burning mixture from the rocket.

The present invention further relates to a method for powering a ramjet or scramjet. A ramjet has no moving parts and achieves compression of intake air by the forward speed of the air vehicle. Air entering the intake of a supersonic aircraft is slowed by aerodynamic diffusion created by the inlet and diffuser to velocities comparable to those in a turbojet augmentor. The expansion of hot gases after fuel injection and combustion accelerates the exhaust air to a velocity higher than that at the inlet and creates positive push. Scramjet is an acronym for Supersonic Combustion Ramjet. The scramjet differs from the ramjet in that combustion takes place at supersonic air velocities through the engine. Hydrogen is normally the fuel used. Pulse detonation engines are also intended to be included in the method of the present invention. The method of the present invention comprises the steps of decomposing the fuel composition of the present invention, preferably via catalytically dehydrogenating, into hydrocarbon components and hydrogen, and cooling of adjacent engine and airframe parts through endothermic cooling. The hydrocarbon components and hydrogen are then burned. The burning hydrogen is also used to maintain flame under ramjet or scramjet conditions.

While particular embodiments of the fuel of the present invention have been illustrated and described, it would be obvious to those skilled in the art that various other changes and modifications can be made without departing from the spirit and scope of the invention. It is therefore intended to cover in the appended claims all such changes and modification that are within the scope of this invention. All documents cited are, in relevant part, incorporated herein by reference; the citation of any document is not to be construed as an admission that it is prior art with respect to the fuel of the present invention.

What is claimed is:

1. A fuel composition for use in jets, gas turbines, rockets, or diesel engines comprising:

(a) from about 5% to about 99% by weight of the fuel composition of a highly branched alkylaromatic or alkylcyclohexane compound consisting of an alkyl moiety having from 5 to 25 carbon atoms and an average of more than 1.0 branches per moiety, and an aromatic moiety; the aromatic moiety being selected from the group comprising benzene, toluene, xylene, a cyclohexane derived from an aromatic moiety, and mixtures thereof; wherein said alkyl moiety of the alkylaromatic or alkylcyclohexane comprises a ratio of nonquaternary carbons to quaternary carbons from about 10:1 to 3:1;

(b) from at least about 0.01% of fuel additives; and (c) from 0% to about 75% of conventional jet, gas turbine, rocket or diesel blendstocks.

2. The fuel composition according to claim 1 wherein the fuel composition is for use in jets, gas turbines, or rockets and the pour point of the fuel composition is about −40° C. to about −80° C.

3. The fuel composition according to claim 1 wherein the flash point of the fuel composition is about 38° C. to about 145° C.

4. The fuel composition according to claim 1 wherein the density of the fuel composition is 0.700 g/mL to about 0.900 g/mL.

5. The fuel composition according to claim 1 wherein the sum of carbons in the alkyl moiety is from $C_{5-14}$.

6. The fuel composition according to claim 1 wherein the fuel composition is for use in diesel engines and the pour point is about −20° C. to about −35° C.

7. The fuel composition according to claim 1 wherein the fuel composition is essentially free of polycyclic aromatic substitutents and essentially free of unreacted benzene.

8. The fuel composition according to claim 1 wherein the fuel composition is a jet fuel having a minimum smoke point of 20 mm.

9. The fuel composition according to claim 1 wherein the fuel composition is for use as a universal battlefield fuel.

10. The fuel composition according to claim 1 wherein said compound (a) has said alkylaromatic or alkylcyclohexane preferably comprises at least 1 quaternary carbon per molecule.

11. The fuel composition according to claim 10, wherein from about 80 wt % to about 100 wt % of the alkylaromatic and/or alkylcyclohexane compound comprise a quaternary carbon formed by the alkyl moiety, the aromatic moiety or cyclohexane derived from the aromatic moiety, and a branch moiety selected from the group consisting of $C_1$-$C_4$ alkyl, and mixtures thereof.

12. A fuel composition for use in jets, gas turbines, or diesel engines comprising:

(a) from about 5% to about 99% by weight of the fuel composition of a highly branched alkylaromatic compound wherein the highly branched alkylaromatic compound comprises an alkyl moiety and en aromatic moiety; the aromatic moiety is selected from the group consisting of benzene, toluene and xylene; the alkyl moiety having from 5 to 25 carbon atoms and an average of more than 1.0 branches per moiety and the alkyl moiety comprises a ratio of nonquaternary carbons to quaternary carbons from about 10:1 to 3:1;

(b) from at lean about 0.01% of fuel additives; and (c) from 0% to about 75% of conventional jet, gas turbine, rocket or diesel blendstocks.

13. A fuel composition for use in jets, gas turbines, rockets, or diesel engines comprising:

(a) from about 5% to about 99% by weight of the fuel composition of a highly branched alkylcyclohexane compound wherein the highly branched alkylcyclohexane compound comprises an alkyl moiety and an cyclohexane moiety; the alkyl moiety having from 5 to 25 carbon atoms and an average of more than 1.0 branches per moiety and the alkyl moiety comprises a ratio of nonquaternary carbons to quaternary carbons from about 10:1 to 3:1;

(b) from at least about 0.01% of fuel additives; and (c) from 0% to about 75% of conventional jet gas turbine, rocket or diesel blendstocks.

* * * * *